United States Patent [19]

Turner

[11] 4,167,987

[45] Sep. 18, 1979

[54] MULTIPLE FLOW MARINE MUFFLER CONSTRUCTED OF RESILIENT MATERIAL

[75] Inventor: William F. Turner, Northbrook, Ill.

[73] Assignee: W. H. Salisbury & Co., Skokie, Ill.

[21] Appl. No.: 899,407

[22] Filed: Apr. 24, 1978

[51] Int. Cl.[2] ..... F01N 7/12

[52] U.S. Cl. ..... 181/235; 181/255; 181/270; 181/272; 181/281; 181/282

[58] Field of Search ..... 181/206, 231, 243, 246, 181/265, 268, 270, 279–282, 235, 212, 255, 264, 269, 272, 275, 283

[56] References Cited

U.S. PATENT DOCUMENTS

| | | | |
|---|---|---|---|
| 1,087,398 | 2/1914 | Persson | 181/282 |
| 2,112,006 | 3/1938 | Abramson | 181/279 |
| 2,202,272 | 5/1940 | Smith | 181/270 |
| 2,392,247 | 1/1946 | Katcher | 181/270 |
| 3,187,837 | 6/1965 | Beeching | 181/246 |
| 3,235,003 | 2/1966 | Smith | 181/231 |
| 3,590,947 | 7/1971 | Latch | 181/265 |

FOREIGN PATENT DOCUMENTS

| | | | |
|---|---|---|---|
| 472605 | 12/1914 | France | 181/281 |
| 1387637 | 12/1964 | France | 181/281 |

*Primary Examiner*—L. T. Hix
*Assistant Examiner*—Benjamin R. Fuller
*Attorney, Agent, or Firm*—Vogel, Dithmar, Stotland, Stratman & Levy

[57] ABSTRACT

A multiple flow marine muffler constructed of resilient material having an elongated generally cylindrical hollow shell with reduced diameter inlet and outlet portions, and longitudinally spaced pairs of opposed baffles within the shell which define a plurality of chambers decreasing in axial length from the chamber adjacent the inlet portion to the chamber adjacent the outlet portion. The several pairs of baffles are so shaped, sized and oriented as to provide multiple flow paths for exhaust gases and cooling water through the muffler, namely, a central straight through path for engine idle condition, a first pair of undulating paths in side by side out of phase relation, and a second pair of undulating paths in side by side out of phase relation which are oriented in the cylindrical shell 90° away from the first pair.

5 Claims, 5 Drawing Figures

MULTIPLE FLOW MARINE MUFFLER CONSTRUCTED OF RESILIENT MATERIAL

BACKGROUND OF THE INVENTION

This invention relates to marine mufflers for the exhaust and cooling water discharges from internal combustion marine engines, and particularly to a muffler constructed of resilient material and so designed as to provide multiple flow paths therethrough for exhaust gases and water.

The invention constitutes an improvement over the mufflers of resilient material shown in Beeching U.S. Pat. No. 3,187,837, dated June 8, 1965. Applicant's assignee has manufactured and sold mufflers constructed in accordance with the teachings of the Beeching patent. In general, these mufflers afford only a single flow path for the exhaust gases and water.

Applicant's assignee also has manufactured and sold other types of mufflers constructed of resilient material, and such other types, together with those of U.S. Pat. No. 3,187,837, are illustrated in a 4-page Circular 9-76 of Salisbury Rubber Products, Marine Division, copy of which is submitted with this application.

Although the mufflers shown in the Beeching patent and in the accompanying Circular constituted steps forward in the art from the standpoints of sound muffling and low back pressure, applicant continued to work with mufflers of this general type in an effort to achieve further improvement. The muffler of this invention possesses improved sound muffling and low back pressure qualities compared with the prior mufflers.

SUMMARY OF THE INVENTION

The muffler of this application is constructed of resilient material and comprises an elongated generally cylindrical hollow shell having inlet and outlet portions of reduced diameter at the ends. Several longitudinally spaced pairs of opposed baffles are disposed transversely within and supported by the hollow shell.

The pairs of baffles define a plurality of chambers which decrease in axial length from the chamber adjacent the inlet portion to the chamber adjacent the outlet portion.

Each pair of opposed baffles has open spaces between the two baffles for the flow of exhaust gases and cooling water, and the shape, size and angular orientation of the baffles cooperate to provide multiple flow paths for exhaust gases and cooling water through the muffler, namely, a generally central straight through path for engine idle condition, a first pair of undulating paths in side by side out of phase relation and a second pair of undulating paths in side by side out of phase relation which are oriented 90° away from the first pair.

The open spaces between each pair of opposed baffles which separate adjacent chambers are substantially equal in total area to the cross-sectional area of the inlet portion of the muffler, as well as the cross-sectional area of the outlet portion.

Thus, the baffles and the open spaces between opposed baffles establish the above described five flow paths for pulsating exhaust gases and cooling water through the muffler. The flow paths, while generally well defined, have interfaces with one another which create turbulence within the muffler. The turbulence, baffles and multiple flow paths promote reflections of pulsating gases back and forth within the several muffler chambers of decreasing length. The reflections result in cancellations of the energy in the expanding gases and in the accompanying noise, and at the same time gas and noise energy is absorbed by the component resilient material of the muffler.

In more detailed aspect, the elongated hollow shell desirably comprises a pair of longitudinal half shells secured together at abutting edges, and the baffles are integral with the half shells, meaning that the complete muffler is an assembly involving two parts of molded resilient material.

In further detail, the baffles each have the general shape of a 135° circular segment and are of such size that when in place in the hollow shell the apexes of an opposed pair are spaced from each other to define the central straight through path.

The baffles of an opposed pair in position within the hollow shell are so related as to define two openings between the baffles that have substantially the same cross-sectional area. In relation to the cylindrical shape of the shell, the openings are pie-shaped and diametrically opposed.

Alternate pairs of opposed baffles have similar angular orientation within the hollow shell, and the intermediate pair of baffles between the alternate pairs has an angular orientation which differs by about 45° from the angular orientation of the alternate pairs, thereby defining the aforesaid four undulating flow paths, as well as the central straight through flow path.

DESCRIPTION OF THE PREFERRED EMBODIMENT

Figures 1, 2, 3, 4, 5:
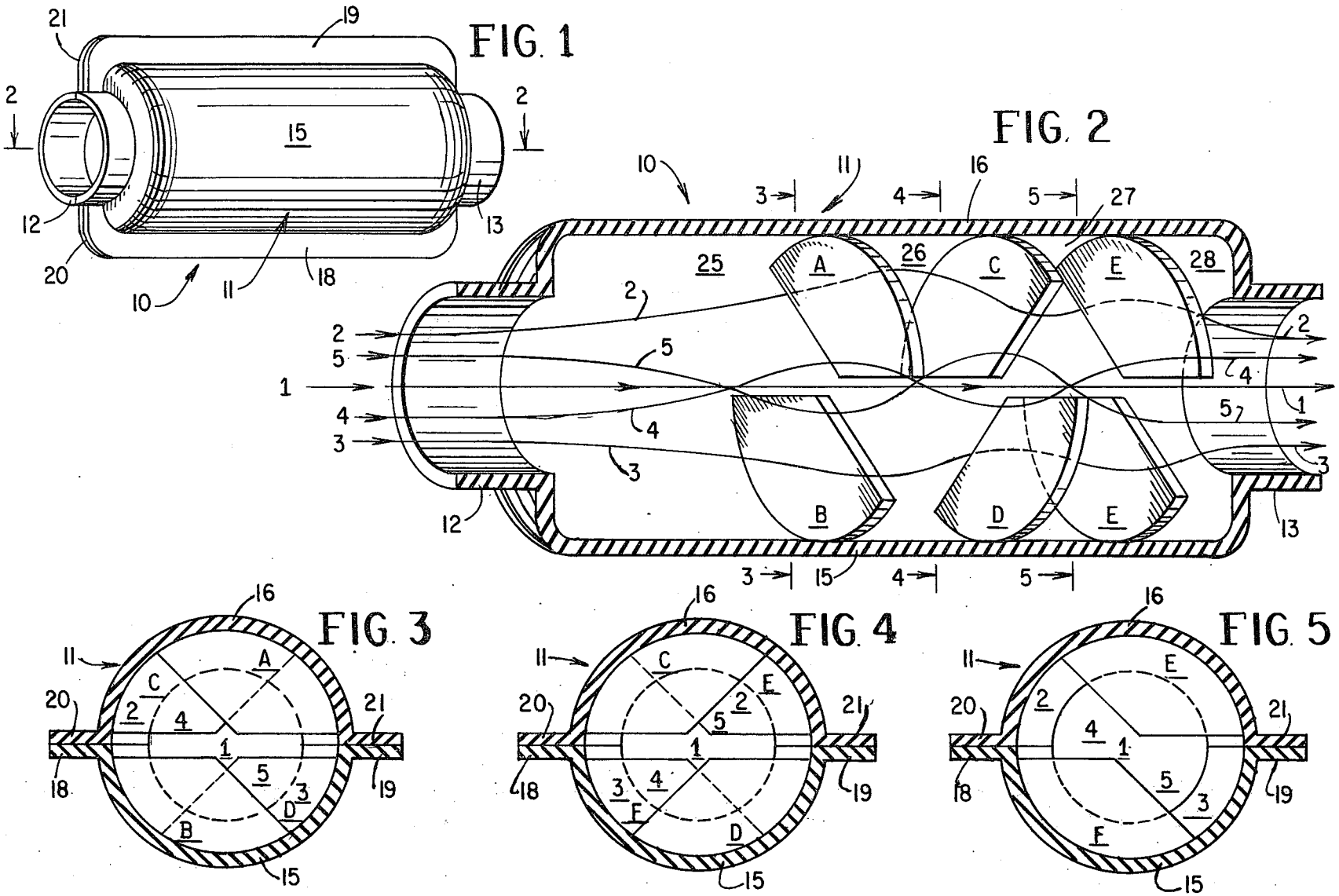
FIG. 1 is a perspective view of the exterior of a multiple flow marine muffler embodying the invention.
FIG. 2 is a perspective longitudinal sectional view of the hollow shell of the muffler taken on line 2—2 of FIG. 1, the interior baffles of the muffler being shown in non-sectional view and in perspective.
FIG. 3 is a cross-sectional view of the complete muffler taken generally on line 3—3 of FIG. 2.
FIG. 4 is a cross-sectional view of the complete muffler taken generally on line 4—4 of FIG. 2.
FIG. 5 is a cross-sectional view of the complete muffler taken generally on line 5—5 of FIG. 2.

Referring to the drawing, FIGS. 1 and 2 illustrate a preferred construction of a muffler 10 embodying the invention. All components of muffler 10 are made of durable, heat resistant resilient material such as neoprene or the like.

Muffler 10 comprises an elongated generally cylindrical hollow shell (FIG. 1) having a reduced inlet portion 12 for attachment to an engine exhaust pipe and a reduced outlet portion 13 of generally the same diameter as the inlet portion. Hollow shell 11, inlet portion 12 and outlet portion 13 are similarly numbered in FIG. 2 where they are shown in longitudinal section.

As shown, shell 11, inlet portion 12 and outlet portion 13 are formed in two longitudinal halves 15 and 16, best shown in FIGS. 2–5. The abutting edges of the halves 15 and 16 have longitudinal flanges which are secured together in assembly. Thus, shell half 15 has longitudinal flanges 18 and 19, and shell half 16 has flanges 20 and 21, as best shown in FIGS. 3–5.

Applicant acknowledges that marine mufflers constructed of resilient material previously have been made in two longitudinal halves generally as shown here.

Accordingly, no broad claim is made to this feature per se.

The interior of shell 11 contains longitudinally spaced pairs of opposed baffles disposed transversely within and supported by the shell. The baffles are designated A–F in FIGS. 2–5. As shown, baffles A–B comprise one cooperating pair of opposed baffles, baffles C–D another pair and baffles E–F a third pair.

The several pairs of baffles, three in the form of the invention shown, define a plurality of chambers 25, 26, 27 and 28 which decrease in axial length from chamber 25 adjacent inlet portion 12 to chamber 28 adjacent outlet portion 13. Muffler chambers of generally the same decreasing axial length are disclosed in the aforesaid Beeching patent where they perform generally the same functions as here.

Baffles A–F each have the general shape of a 135° circular segment (FIGS. 3–5), and they preferably are integral with shell halves 16 and 17. Thus, baffles B, D and F are integral with shell half 15, and baffles A, C and E are integral with shell half 16, as well shown in FIGS. 2–5.

As previously mentioned, baffles A–F are arranged in diametrically opposed pairs within shell 11. The baffles of each opposed pair are of such size that the apices of the baffles are spaced from each other. The spaces between the baffles along the longitudinal axis of the muffler generally define the central straight through path which is particularly effective during engine idle condition.

The diametrically opposed relation between the two baffles of each pair provides two diametrically opposed spaces between the baffles, the two spaces being of substantially the same cross-sectional area, each having the general shape of a 45° circular segment. The opposed spaces between the two baffles of a pair are well shown in FIGS. 3–5.

Alternate pairs of opposed baffles have similar angular orientation within shell 11. Thus, baffle pair A–B (FIGS. 2 and 3) and baffle pair E–F (FIGS. 2 and 5) have the same angular orientation.

A pair of baffles, for example, baffles C–D, between alternate pairs A–B and E–F have an angular orientation in shell 11 which differs by about 45° from the orientation of the alternate pairs. The orientations described, together with the shape and size of the baffles, establish two pairs of undulating flow paths for exhaust gases and cooling water, as well as the aforesaid central straight through flow path.

The several flow paths through the muffler are illustrated to the extent possible by lines in FIG. 2 designated by numerals 1–5. The same numerals are applied to cross-sectional FIGS. 3–5 to indicate more or less diagrammatically the flow paths as they pass through the respective baffle pairs.

It will be understood, of course, that the flow paths interface with one or another as they progress through the muffler, and that turbulence occurs at the interfaces and occurs in varying degree throughout the entire interior of the muffler. The turbulence which occurs is one of the factors that helps dissipate the pressure and noise energy contained in the exhaust gases and the cooling water, thereby cooperating to reduce noise. Further, the turbulence interferes with the regularity of the two pairs of undulating flow paths, and causes energy reflections within the several chambers. The reflections produce cancellation effects, and contribute to the dissipation of exhaust pressures and noise.

Finally, the resilient material of which the shell and baffles are constructed has an energy-absorbing characteristic which further contributes to noise reduction. High frequency noise particular is attenuated significantly, and the low frequency noise is reduced by reason of the sound-absorbing qualities of the shell and baffles.

Referring to FIG 2, and facing in the direction of gas and water flow through the muffler, the five flow paths provided by the baffles now will be described.

The straight through path which is particularly effective during engine idle condition is designated in FIG. 2 by the numeral 1. This path is generally on the axis of the muffler, and is defined by the space between the apexes of the baffles of each baffle pair. This path also is similarly designated in FIGS. 3–5.

The two paths designated by the numerals 2 and 3 constitute one pair of undulating paths which are in side by side and out of phase relation. Referring to FIG. 2 and looking in the direction of gas and water flow from left to right, path 2 passes baffle A on the left (FIG. 3), passes baffle C on the right (FIG. 4) and passes baffle E on the left (FIG. 5). Path 3 passes baffle B on the right (FIG. 3), baffle D on the left (FIG. 4) and baffle F on the right (FIG. 2). Thus, it will be understood that these two paths 2 and 3 undulate in side by side out of phase relation, the two paths generally located in the upper and lower longitudinal halves, respectively, of cylindrical shell 11.

The other two paths designated by the numerals 4 and 5 also undulate in side by side out of phase relation. However, these two paths are generally located in the left and right longitudinal halves, respectively, of shell 11. Referring to FIG. 2, path 4 passes baffle A on the left (FIG. 3), passes baffle D on the left (FIG. 4) and passes baffle E on the left (FIG. 5). Path 5 passes baffle B on the right (FIG. 3), passes baffle C on the right (FIG. 4) and passes baffle F on the right (FIG. 5).

These more or less well defined multiple paths contribute to the rapid expansion of the pressurized exhaust gases within the several chambers, and the turbulence at the interfaces of the paths produces energy reflections and consequent concellations which rapidly and effectively attenuate noise inherent in the engine exhaust.

When the engine is in idle condition, the comparatively low volume gas generally travels along path 1 on the axis of the muffler, gas expansion, of course, occurring in each of the successive chambers of decreasing axial length. The cooling water is not extensively agitated with the engine in idle condition, and generally flows through the lower portion of the muffler.

At intermediate cruise and full throttle conditions of engine operation, the volumes of exhaust gases and cooling water are correspondingly higher, necessitating the dissipation of higher energy levels of pressure energy and noise.

At higher engine speeds, greater turbulence occurs within the muffler, and the cooling water, which also cools the hot gases, as well as the muffler itself, tends to atomize, and much of it travels through the muffler on paths generally like those followed by the expanding exhaust gases.

Comparative tests of the multiple path muffler of this invention and prior mufflers of resilient material have demonstrated at varying levels of engine speed that the muffler of this invention has improved characteristics from the standpoints both of muffling sound and minimizing back pressure.

From the above description it is thought that the construction and advantages of this invention will be readily apparent to those skilled in the art. Various changes in detail may be made without departing from the spirit or losing the advantages of the invention.

Having thus described the invention, what is claimed as new and desired to secure by Letters Patent is:

1. A multiple flow marine muffler constructed of resilient material, comprising:

an elongated generally cylindrical hollow shell having an inlet portion of reduced diameter for attachment to an engine exhaust pipe and an outlet portion of generally the same reduced diameter;

longitudinally spaced pairs of diametrically opposed spaced baffles disposed transversely within and supported by said hollow shell and defining a plurality of chambers decreasing in axial length from the chamber adjacent said inlet portion to the chamber adjacent said outlet portion, said baffles and the openings between the opposed baffles of each pair providing multiple flow paths for exhaust gases and cooling water, namely, a generally central straight through path for engine idle condition, a first pair of undulating paths in side by side out of phase relation and a second pair of undulating paths in side by side out of phase relation, said second pair oriented in said cylindrical shell 90° away from said first pair, the openings between each pair of opposed baffles which separate adjacent chambers being at least equal in total area to the cross-sectional area of said inlet portion, whereby back pressure is minimized and noise is modulated from high volume high frequency to low volume low frequency due to gas expansion and energy reflections in said chambers of decreasing length which result in energy cancellations and to the energy-absorbing characteristics of the component resilient material.

2. The multiple flow marine muffler of claim 1 wherein said elongated hollow shell comprises a pair of longitudinal half shells secured together at abutting edges, and said baffles are integral with said half shells.

3. The multiple flow marine muffler of claim 1 wherein said baffles each have the general shape of a 135° circular segment and are of such size that the apexes of an opposed pair are spaced from each other to define said central straight through path.

4. The multiple flow marine muffler of claim 3 wherein said baffles of an opposed pair are so related as to define two diametrically opposed pie-shaped openings through the baffles that have substantially the same size.

5. The multiple flow marine muffler of claim 4 wherein alternate pairs of opposed baffles have similar angular orientation within said hollow shell, and an intermediate pair of baffles between said alternate pairs has an angular orientation which differs by about 45° from the angular orientation of said alternate pairs.

* * * * *